United States Patent [19]

Maniscalki

[11] 3,980,114

[45] Sept. 14, 1976

[54] COMBINED PENCIL CLIP AND SHARPENER

[75] Inventor: Peter Maniscalki, Bayonne, N.J.

[73] Assignee: Lawrence Peska Associates, Inc., New York, N.Y.

[22] Filed: Nov. 13, 1975

[21] Appl. No.: 631,428

[52] U.S. Cl. ..... 145/3.31; 145/3.61

[51] Int. Cl.[2] ..... B43L 23/00

[58] Field of Search ..... 145/3.3, 3.31, 3.61

[56] References Cited

UNITED STATES PATENTS

| | | | |
|---|---|---|---|
| 879,998 | 2/1908 | Augir | 145/3.31 |
| 2,708,905 | 5/1955 | Randall | 145/3.61 |

FOREIGN PATENTS OR APPLICATIONS

| | | | |
|---|---|---|---|
| 344,989 | 12/1921 | Germany | 145/3.31 |
| 1,805,118 | 5/1970 | Germany | 145/3.61 |

*Primary Examiner*—Al Lawrence Smith
*Assistant Examiner*—J. T. Zatarga
*Attorney, Agent, or Firm*—Jack D. Slobod

[57] ABSTRACT

A combined pencil clip and sharpener includes a body having an oblique tapered bore into which projects a sharpening blade. A reservoir for shavings formed below the tapered bore is in communication therewith via a slot. A removably retained cap forms a bottom wall of the reservoir. Opposed arcuate fingers project from the body for engagement about a pencil and a clip arm projects from the body generally perpendicular to the fingers.

1 Claim, 3 Drawing Figures

COMBINED PENCIL CLIP AND SHARPENER

FIELD OF THE INVENTION

The present invention relates generally to a combined pencil clip and sharpener. In its particular aspects the present invention relates to the provision of a reservoir for collecting shavings in a combined sharpener and pencil clip.

BACKGROUND OF THE INVENTION

Often when using a pencil, a sharpener for the pencil is not available. While the prior art has recognized the advantage of providing a sharpener retained on a pencil for ready use, as illustrated in U.S. Pat. No. 2,708,905 to Randall, the prior art has not adequately dealt with the problem of the litter produced by the resultant shavings from the pencil.

OBJECTS OF THE INVENTION

It is an object of the present invention to provide a combined pencil clip and sharpener which includes a reservoir for collecting shavings.

It is a further object of the present invention to provide a simple and inexpensive pencil sharpener for retention on a pencil.

SUMMARY OF THE INVENTION

Briefly, the aforementioned and other objects of the present invention are satisfied by providing a combined pencil clip and sharpening device which includes a body having a tapered bore for receiving the writing end of a pencil. A sharpening blade is mounted projecting into the bore.

A reservoir for shavings is formed in the body in communication with the bore and a removable cap threadably retained on the body forms a wall of the reservoir. By removing the cap, the shavings may be disposed of.

For gripping a pencil, in order to be carried thereon, resilient opposed arcuate fingers project from the body. Further a clip arm projects from the body perpendicular to the fingers for alignment along the pencil.

Other objects, features and advantages of the present invention will become apparent upon perusal of the following detailed description of the preferred embodiment thereof when taken in conjunction with the appended drawing wherein.

DETAILED DESCRIPTION

Figure 1:
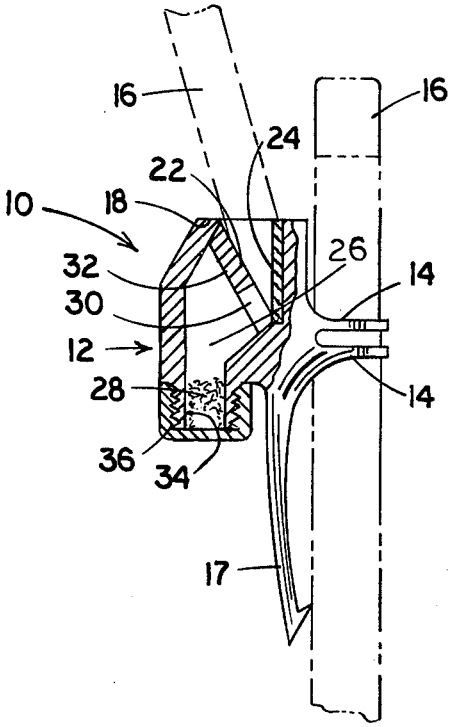
FIG. 1 is a side elevational view of the combined pencil clip and sharpener of the present invention.
Figure 3:
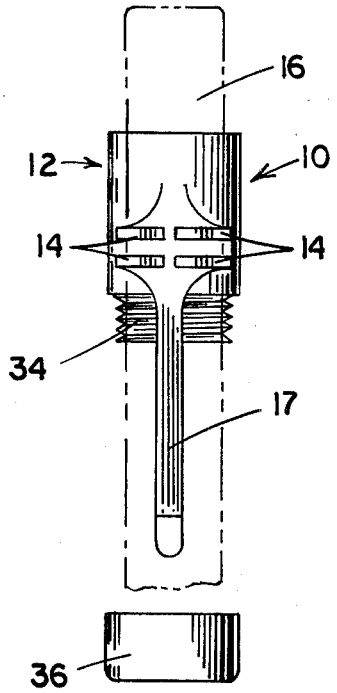
FIG. 3 is a rear elevational view of the combined pencil clip and sharpener in FIG. 1.
Figure 2:
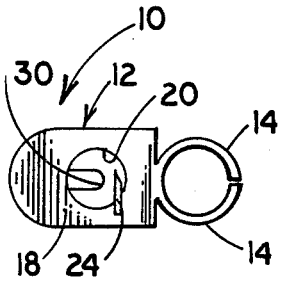
FIG. 2 is a top view of FIG. 1.

Referring to FIGS. 1 and 2 of the drawing, the combined pencil sharpener and clip device of the present invention is generally indicated by the reference numeral 10. Device 10 includes a decoratively shaped body 12 having opposed arcuate sets of resilient fingers 14 projecting therefrom for engagement about a pencil 16 so that body 12 may be carried by the pencil. A clip arm 17 projects from body 12 at the root of fingers 14 generally perpendicular to the fingers for alignment along the side of pencil 16 to enable the pencil to be carried on a pocket.

The body 12 has a generally planar top surface 18 which includes an aperture 20 forming the mouth of tapered bore 22 into body 12 directed oblique to surface 18. A sharpening blade 24 is provided mounted projecting into bore 22. As should be apparent, the bore 22 is provided for receiving the writing end of pencil 16 after the removal of device 10 from the pencil so that it may be sharpened by blade 24.

The lower portion of body 12 comprises a reservoir 26 for shavings 28 from the sharpening operation. The reservoir 26 communicates with bore 22 via a slot 30 in a wall 32 separating the bore and the reservoir. A cylindrical externally threaded tubular mouth 34 is provided at the bottom of body 12 and an internally threaded cap 36 is engaged on the mouth to form a bottom wall of reservoir 26.

Thus, the shavings 28 may be collected in reservoir 26 until it is substantially filled. Then the cap 36 is unscrewed for emptying the reservoir.

While the preferred embodiment of the present invention has been described in specific detail, it should be understood that numerous modifications, additions and omissions in the details thereof are possible within the intended spirit and scope of the invention claimed herein.

What is claimed is:

1. A combined pencil clip and sharpener device comprising:

a body having a tapered bore for receiving the writing end of a pencil; a sharpening blade mounted in said body projecting into said bore; a reservoir for shavings formed in said body in communication with said bore; a removable cap threadably retained on said body forming a wall of said reservoir, resilient opposed arcuate fingers projecting from said body for frictionally engaging a pencil and a clip arm projecting from said body generally perpendicular to said fingers.

* * * * *